United States Patent [19]

Bryant et al.

[11] Patent Number: 4,742,195

[45] Date of Patent: May 3, 1988

[54] HIGH TEMPERATURE HERMETIC SWITCH

[75] Inventors: Cal L. Bryant, Bartlett; David W. Vrona, Glen Ellyn; Dennis E. Francoeur, Glendale Heights; Paul G. Janitch, Lombard, all of Ill.

[73] Assignee: Magnetrol International Incorporated, Downers Grove, Ill.

[21] Appl. No.: 803,810

[22] Filed: Dec. 2, 1985

[51] Int. Cl.[4] ..... H01H 9/04

[52] U.S. Cl. ..... 200/84 C; 200/302.1; 200/67 B; 200/81.4; 335/206; 335/207

[58] Field of Search ..... 200/84 C, 84 R, 81.9 M, 200/81.4, 67 B, 302.1; 335/100, 127, 128, 188, 189, 206, 207

[56] References Cited

U.S. PATENT DOCUMENTS

| | | | |
|---|---|---|---|
| 1,854,316 | 4/1932 | Teesdale | 200/67 B |
| 2,612,572 | 9/1952 | Binford | 200/84 C |
| 2,840,657 | 6/1958 | Roeser | 200/67 B |
| 4,066,858 | 1/1978 | Piper | 200/84 C |
| 4,243,857 | 1/1981 | Reis | 200/83 C |
| 4,335,285 | 6/1982 | West | 200/84 C |

FOREIGN PATENT DOCUMENTS

| | | | |
|---|---|---|---|
| 1191870 | 5/1970 | United Kingdom | 200/84 C |

*Primary Examiner*—A. D. Pellinen
*Assistant Examiner*—H. L. Williams
*Attorney, Agent, or Firm*—Wood, Dalton, Phillips, Mason & Rowe

[57] ABSTRACT

A process instrument enclosed in a hermetically sealed housing for indicating and controlling a measured variable, such as the level in a tank. The instrument includes magnetically operated electrical switches actuable between open and closed positions in response to the measured variable. The electrical switches used are capable of switching current levels on the order of 10 Amps.

11 Claims, 2 Drawing Sheets

HIGH TEMPERATURE HERMETIC SWITCH

FIELD OF THE INVENTION

This invention relates to a process instrument and more particularly to a magnetically operated and hermetically sealed switch.

BACKGROUND OF THE INVENTION

Prior art process instruments, such as Binford U.S. Pat. No. 2,612,572, assigned to the assignee of this application, used floats or the like in conjunction with magnetically operated electrical switches to indicate or control a condition, for example, level. The movement of the float moves a magnet thereby actuating the switch.

It is sometimes necessary to mount the instrument on a process vessel where it may be subject to adverse environmental conditions. A typical example of such an application is in a chemical plant. In certain parts of the plant the air may be dirty or dusty. Also, the operation of the equipment and reactions taking place may produce high temperatures on the order of 750° Fahrenheit. Many process instruments will not operate reliably in this type of environment.

For maintenance reasons, it is also beneficial to have an instrument that can be easily adjusted or replaced with minimal difficulty and without affecting the associated process. Such an instrument could also be retro-fit to existing process vessels.

Prior art process instruments used in the aforementioned environments frequently have a sealed switch, such as a reed switch, to control and indicate a process variable. However, reed switches can only switch circuits operating at low current levels and must therefore be coupled to an interposing relay in order to switch devices requiring higher levels of current. Further, other components in these prior art devices break down at high temperatures.

In view of the above, it is desirable to have a process instrument, such as an electrical switch, that is operable in harsh environments and at high temperatures while switching higher current levels. The present invention is intended to overcome one or more of the problems as set forth above and satisfy these needs.

SUMMARY OF THE INVENTION

It is an object of this invention to provide a process instrument, in a hermetically sealed housing, magnetically operable to move a switch between an opened and a closed position in response to the value of the variable being measured.

In accordance with this invention, the process instrument is used on a vessel having a closed tube extending outwardly, the tube having a rod and magnetic material slidably mounted therein, the rod and magnetic material being movable in response to the measured variable. A hermetically sealed housing has a mounting hole extending its full length through which the tube extends and means are provided for securing the housing to the tube. A carrier is pivotally mounted within the housing, the carrier being movable between a first and a second position, with a spring normally urging the carrier to the first position. A magnet is also secured to the carrier, the magnet acting to overcome the force applied by the spring and move the carrier to the second position when the magnetic material is moved in the tube to a position in proximity to the housing. The process instrument further includes a switch actuator movable in response to movement of the carrier and a switch, the switch being actuable in response to movement of the switch actuator.

Another feature of this invention is that a clamp is provided on the housing to secure the housing to the tube. The clamp allows for proper positioning of the housing on the tube to adjust the level at which the switch will be actuated.

A further feature of this invention is the utilization of a spring extending through an opening in the switch actuator to operate the switch between positions in an overcentered arrangement.

Yet another feature is the use of a pivoting carrier, along with a fixed switch, acting as a crank to move the switch actuator linearly.

Further features and advantages of this invention will readily be apparent from the specification and from the drawings.

DESCRIPTION OF THE INVENTION

The embodiment of the invention illustrated in the enclosed drawings and specification is an instrument responsive to the level in a process vessel. The instrument could respond to other process variables such as pressure, temperature or flow.

Figure 1:
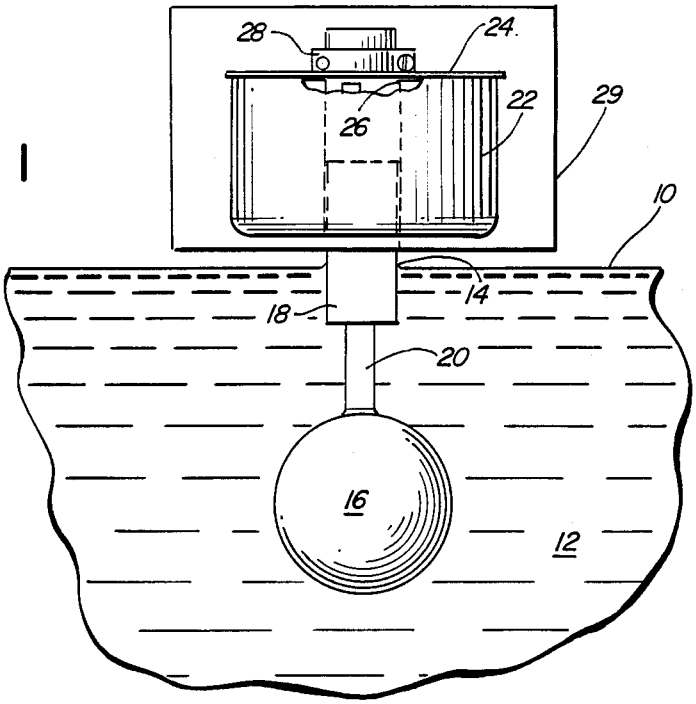
FIG. 1 is an elevation illustrating a typical installation using the switch.

Referring first to FIG. 1, a process vessel or tank 10 contains a substance 12, the level of which is to be measured and controlled. The tank 10 has a closed tube 14 extending upwardly from the vessel. A float 16 in the tank is connected with a body of magnetic material 18 at the upper end of a float rod 20. The magnetic material 18 is either partially or entirely located in the tube 14.

As the level of the substance 12 in the tank 10 rises or falls the float 16 will rise or fall, correspondingly, causing the rod 20 and magnetic material 18 to do so also.

The particular style of float 16 used may be dependent on the substance 12 contained in the tank 10 and is not part of this invention. Also, the length of the rod 20 is selected according to the size of the tank used and the normal operation level in the tank.

Figure 2:
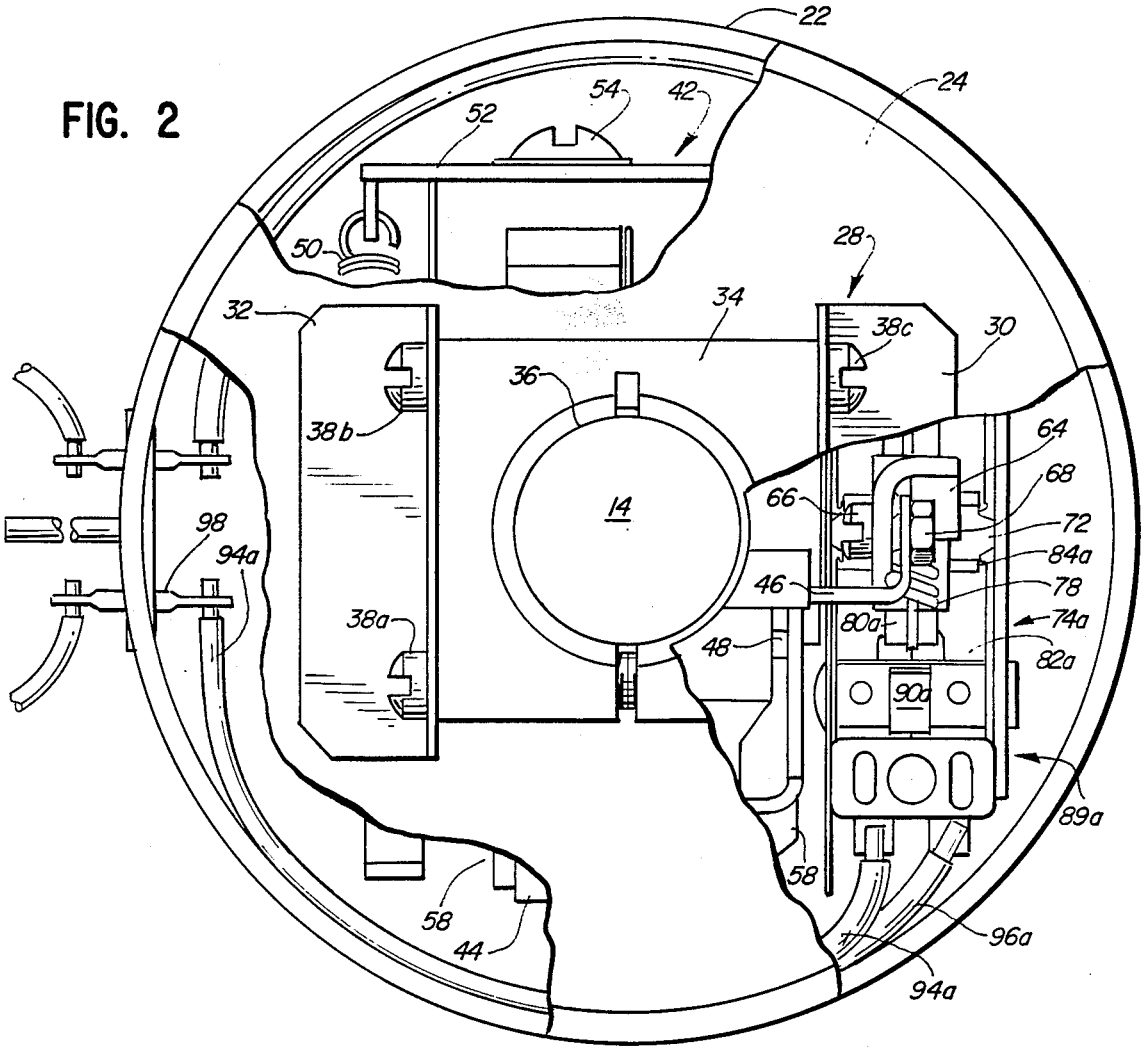
FIG. 2 is a plan view of the hermetic housing with the top shown partially cut away.
Figure 3:
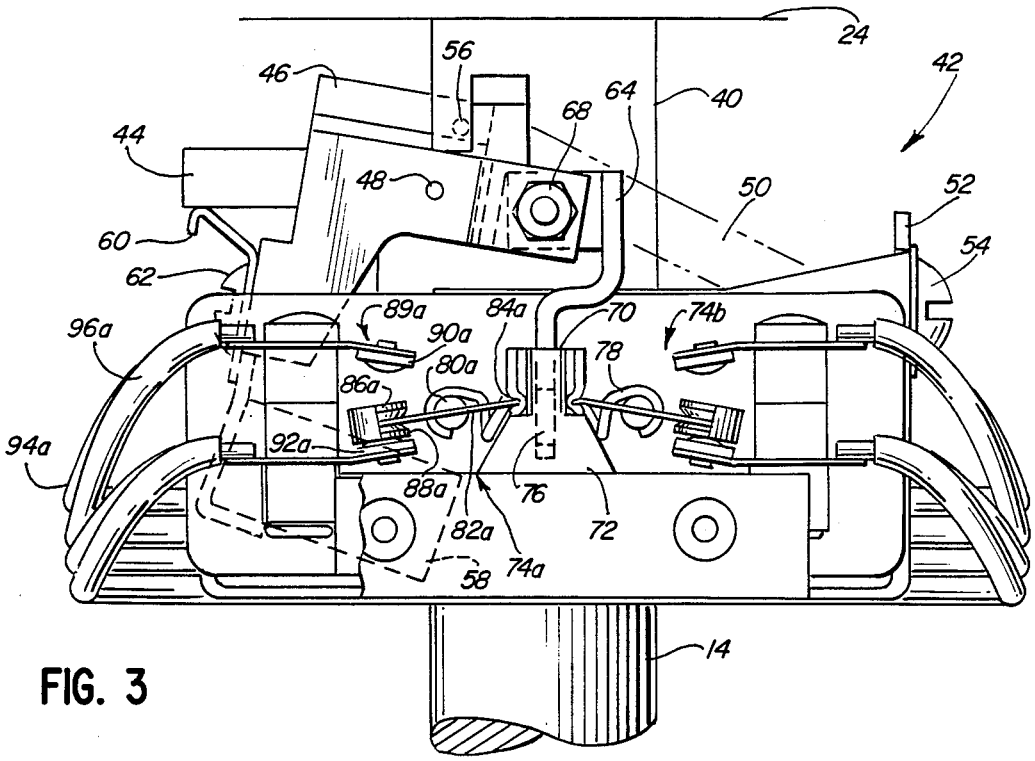
FIGS. 3 and 4 illustrate the operating parts of the magnet carrier and switch in their first and second positions.
Figure 4:
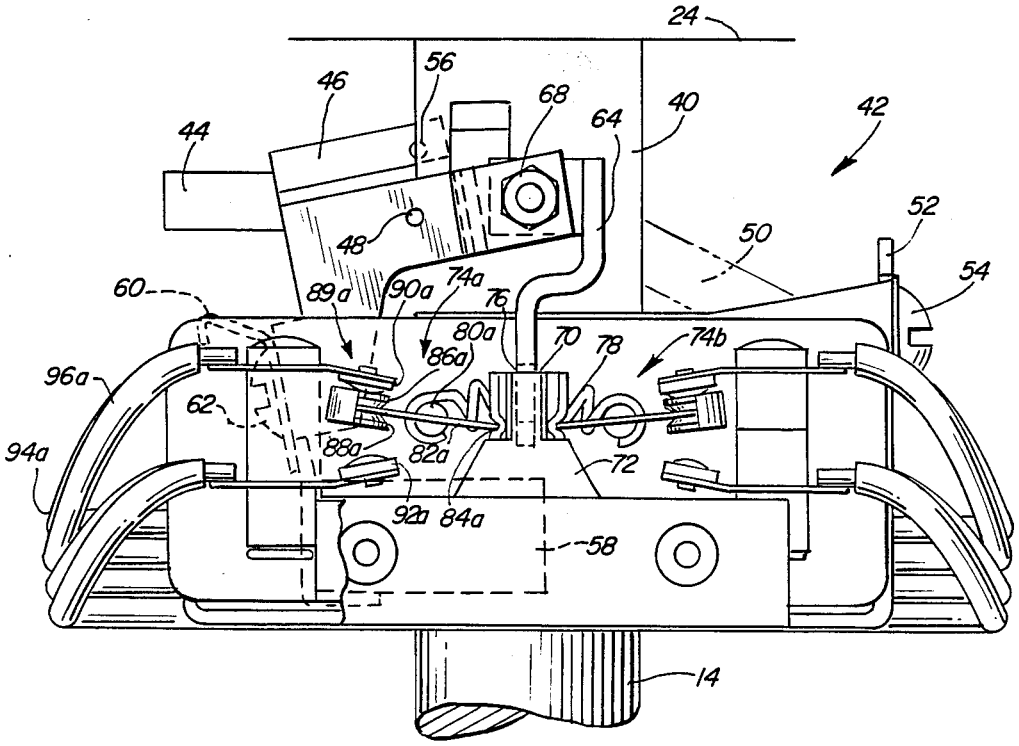

A hermetically sealed housing 22 encloses a switch and actuator assembly, shown in FIGS. 2–4. The housing 22 is cup-shaped with a continuous bottom and outer wall. A circular cover 24 is secured at its periphery to the top edge of the outer wall of the housing 22. The bottom of the housing 22 and the cover 24 each have a centrally located opening, and a tubular inner wall 26 extends therebetween. The inner wall 26 is of a sufficient diameter to fit over the tube 14. The hermetically sealed housing 22 prevents contaminants from damaging the switch and actuator assembly.

Once the housing 22 is placed over the tube 14 a clamp 28 secures the housing 22 to the tube 14. The precise position of the housing 22 on the tube 14 will be determined by the level of substance 12 at which the switch is to be actuated. For any given level in the tank 10, the magnetic material 18 will assume a related position within the closed tube 14. The housing 22 is clamped in place at a position in proximity to the location of the magnetic material 18 in the tube 14 according to the desired level.

Although not required for the switch to operate properly, the housing 22, when mounted on the tube, is generally located within an outer enclosure 29. The outer enclosure 29 provides a protective environment for electrical conductors and terminations, discussed hereinafter, which couple the switch to external devices.

Referring now to FIG. 2, a top view of the hermetic housing is shown with parts of the housing cover 24 cut away to expose the switch and actuator assembly. The clamp 28 is a pair of L-shaped brackets 30 and 32 each affixed to the cover 24. A compression connector 34 having an opening 36 through which the tube 14 extends, is held between the brackets 30 and 32 by machine screws 38*a*–38*c*. When the housing 22 is properly positioned on the tube 14, the machine screw 38*a* is tightened to secure the housing 22 in position.

Details and operation of the present invention will now be discussed with reference to FIGS. 2, 3 and 4 with like numerals designating like parts in each of the figures.

The inner wall 26 of the housing 22 has an inner surface 40 entirely within the housing 22. A switch assembly 42 surrounds this inner surface 40 in the housing 22.

A switch frame assembly 44 is secured within the housing 22. A rocker arm or carrier 46 extends around the perimeter of the switch frame assembly 44 and is pivotally connected thereto at a point 48 on either side of the switch frame assembly 44. A fall-out spring 50 is attached at one end to a fixed plate 52. The plate 52 is secured to the switch frame assembly 44 with a machine screw 54.

The second end of the fall-out spring 50 is attached to an opening 56 on the rocker arm 46, with the force of the fall-out spring 50 causing the rocker arm 46 to remain in a first position, FIG. 3.

A U-shaped magnet 58 is also secured to the rocker arm 46 with its opening sized to extend around either side of the inner surface 40 of the wall 26. A bracket 60 is secured to the rocker arm 46 with a machine screw 62. The bracket 60 acts as a stop thereby limiting pivotal movement of the rocker arm 46. The bracket 60 is positioned so that the arcuate movement of the rocker arm 46 is equidistant above and below a horizontal plane through the pivot point 48.

As discussed above, the switch assembly 42 is hermetically sealed in the housing 22 with the housing 22 secured to the closed tube 14 of the tank 10. As the level of the substance 12 in the tank 10 rises it causes the magnetic material 18 to rise in the closed tube 14. As the magnetic material 18 rises, it reaches a level in close proximity to the magnet 58 of the switch assembly 42. The attractive force produced between the magnet 58 and the magnetic material 18 increases until the magnetic force on the carrier 46 overcomes the force from the fall-out spring 50. The rocker arm 46 then pivots about its connection point 48, until the magnet 58 abuts the inner surface 40, the rocker arm thereby assuming its second position, FIG. 4.

When the level in the tank 10 decreases the magnetic material 18 in the closed tube 14 drops and reaches a point where the force on the rocker arm 46 created by the fall-out spring 50 again exceeds that created between the magnet 58 and the magnetic material 18. At that time the rocker arm 46 returns to the first position.

A switch actuator 64 is hingedly connected to the rocker arm 46 with a screw 66 and nut 68. The screw 66 and nut 68 are loosely connected to allow for relative movement between the rocker arm 46 and switch actuator 64. The lower end of the switch actuator 64 is slidably positioned in an opening 70 which extends through a switch base 72. The switch base 72 is composed of an electrically insulating high temperature material and is fixed to the housing 22 by means of the fixed plate 52. As the magnet 58 causes the rocker arm 46 to pivot relative to the fixed switch base 72, the rocker arm 46 acts as a crank allowing for linear movement of the switch actuator 64.

In the embodiment shown the switch includes two switch assemblies 74*a* and 74*b*. However, the invention will operate, albeit less efficiently, with a single switch assembly. Since each switch assembly 74*a* and 74*b* has similar components only one switch assembly 74*a* will be discussed in detail.

The switch actuator 64 is a plate having a hole 76 (shown in dashed lines) through which a switch spring 78 extends. One end of the switch spring 78 is attached to a spring insulator 80*a*. The spring insulator 80*a* is coupled to flapper or switch arm 82*a* at its mid-portion. The switch spring 78 holds the flapper 82*a* under tension. The inner end of the flapper 82*a* rests in a notch in a metal bearing surface 84*a*, the metal bearing surface 84*a* being secured to its respective side of the switch base 72. The bearing surface 84*a* allows for pivotal movement of the 82*a*. At the outer end of the flapper 82*a*, away from the switch base 72, are a first and a second contact pad 86*a* and 88*a*. The first contact pad 86*a* extends the width of the upper surface of the flapper 82*a*. The second contact pad 88*a* extends the width of the lower surface of the flapper 82*a*.

Also associated with switch assembly 74*a* is a contact block 89*a* having an upper 90*a* and a lower 92*a* pair of contact points. As better shown in FIG. 2, each of the contact points of the upper pair 90*a* has a respective conductor 94*a* and 96*a* secured thereto. The opposite end of each conductor 94*a* and 96*a* is connected to a terminal point 98, typical. The terminal point 98 extends through to the outside of the housing 22, and may then be connected to an external device, such as a power supply or control element.

With the rocker arm 46 in the first position, as shown in FIG. 3, the switch actuator 64 is in its full downward position. This causes the switch spring 78 to force the flapper arms of both switch assemblies 74*a*, 74*b* to pivot to their downward positions. As a result, the lower contact pad 88*a* of switch assembly 74*a* comes in contact with both of the contact points of the lower pair of contact points 92*a*, thereby providing a closed or completed circuit. Conversely, an open circuit exists across the contact points of the upper pair of contact points 90*a*.

As the level in the tank 10 increases the magnetic material 18 at the upper end of the float rod 20 attracts the magnet 58 causing the rocker arm 46 to pivot moving the switch actuator 64 upwardly. As the switch actuator 64 moves upwardly pulling the switch spring 78 with it, the switch spring 78 operates in an overcentered arrangement and causes the flappers of the two assemblies to pivot in an upward direction. FIG. 4 illustrates this position. Consequently, a closed circuit exists between the contact points of the upper of contact points 90*a* and their associated terminals, while there is an open circuit between the contact points of the lower pair of contact points 92*a*.

To prolong reliable operation of the switch, the housing 22 is purged and filled with clean air prior to being hermetically sealed. Where added protection is desired, the housing 22 may also be filled with an inert gas. The inert gas is selected to decrease the likelihood of oxidation of the contacts.

The switch assembly 74*a* operates as a snap-action switch with a break-before-make feature. The snap-action provides a precise point at which the flapper arm will switch between the upper and lower position without lingering between the two positions. The snap-action also lessens contact arcing thereby prolonging contact life.

The use of a snap-action switch in the disclosed construction provides a process instrument using contact pads, and contact points capable of switching circuits operating at current levels as high as 10 Amps. Such a result allows this instrument to be incorporated directly in most control circuits without the need for external devices to interface with the control circuit.

With the break before make feature the circuit for one pair of contact points opens prior to the time at which the circuit for the second pair of contact points closes. As a result of this, each pair of contacts can be used in a different circuit with each circuit possibly having different voltage levels. For example, the lower pair of contact points 92*a* could be used to operate a pump having a 120 V AC starter, while the upper pair of contacts 90*a* switch a high alarm lamp operating at 24 V DC.

Similarly, each switch assembly 74*a* and 74*b* is insulated from one another further maximizing the flexibility of control available.

In order for the disclosed switch to maintain reliability under high temperature conditions, components must be selected to withstand temperatures on the order of 750° F. Specifically, the non-metallic parts such as the switch base 72, the spring insulator 80*a* and the contact block 89*a*, should not break down at these temperatures. The use of such components, and hermetically sealing the housing 22, allows the switch to be used in harsh environments.

By providing a housing 22 to mount on a closed tube 14 of a process vessel 10, the instrument can be easily maintained without interfering with the process itself. Simple lossening of the clamp 26 and removal of conductors from terminals 98 allows the housing 22 to slide off the tube 14. A new housing 22 can then be used or the existing one repaired and replaced. Similarly, this invention can be used as a retro-fit device on an existing process vessel. Some prior art process instruments operate on a similar principal to this invention and can therefor be replaced with the instant control apparatus to obtain its many benefits previously discussed.

We claim:

1. An electrical switch comprising:

a base;

a bearing surface on said base;

a flapper;

a coil spring under tension connected with said flapper and holding an end of the flapper seated on said bearing surface, said flapper pivoting on said bearing surface between first and second portions;

a switch actuator linearly movable in a direction generally at right angles to the plane of said flapper and its pivotal axis, said actuator being operably associated with said spring to move the spring and swing the flapper between the first and second positions with an overcentered action;

an electrical contact on said flapper; and fixed electrical contacts cooperating with said flapper contact in at least one of said first and second positions.

2. The switch of claim 1 in which said base has a central leg with oppositely facing bearing surfaces one on each side, a pair of flappers one seated in each bearing and in which the coil spring is connected under tension between the two flappers holding both in their respective bearings.

3. The switch of claim 1 in which said bearing is a notch in the base surface.

4. The switch of claim 1 in which said base is an insulating material and said bearing is metal.

5. The switch of claim 1 in which said actuator is a plate with a hole therein, said spring extending through said hole.

6. The switch of claim 11 in which said base has a slot therein and said actuator moves in said slot.

7. A hermetic switch responsive to a process variable in which a body of magnetic material is moved in a closed tube as a function of the variable, the switch comprising:

a cup-shaped hermetically sealed housing with a continuous bottom and outer wall, the bottom having a centrally located opening therethrough, a circular cover secured at its periphery with a top edge of said outer wall and having a centrally located opening therethrough and a tubular inner wall extending between the opening in the bottom wall and the opening in the cover, the closed tube in which the body of magnetic material is moved extending through the tubular inner wall of the housing;

means securing the housing at a selected position on the tube, adjacent the path of movement of said body of magnetic material;

a magnet in said housing operatively related to said body of magnetic material and movable between first and second positions in accordance with the position of said body of magnetic material; and a switch in said housing connected with said magnet for movement between first and second switch positions in accordance with movement of the magnet.

8. A hermetic switch responsive to a process variable in which a body of magnetic material is moved in a closed tube as a function of the variable, the switch comprising:

a hermetically sealed housing having an annular outer wall, a bottom and a cover, both the bottom and the cover having openings therethrough and a tubular inner wall extending between the openings, said closed tube extending through the tubular inner wall of the housing;

means securing the housing at a selected position on the closed tube, adjacent the path of movement of said body of magnetic material;

a magnet in said housing operatively related to said body of magnetic material and movable between first and second positions in accordance with the position of said body of magnetic material; and a switch in said housing connected with said magnet for movement between first and second switch positions in accordance with movement of the magnet.

9. The hermetic switch of claim 8 in which the housing is cup-shaped with one of the bottom and cover being continuous with the outer wall.

10. The hermetic switch of claim 8 in which the openings in the bottom and cover are centrally located of the housing.

11. The hermetic switch of claim 8 having a clamp on the housing for securing the housing at a selected position on said closed tube.

* * * * *